US009267392B2

(12) United States Patent
Schroder et al.

(10) Patent No.: US 9,267,392 B2
(45) Date of Patent: Feb. 23, 2016

(54) VACUUM PUMP

(75) Inventors: Ulrich Schroder, Saint Marcel (FR); Eduardo Carrasco, Saint Marcel (FR); Benoit Henry, Saint Marcel (FR)

(73) Assignees: EDWARDS JAPAN LIMITED, Chiba (JP); SOCIETE DE MACANIQUE MAGNETIQUE, Saint Marcel (FR)

( * ) Notice: Subject to any disclaimer, the term of this patent is extended or adjusted under 35 U.S.C. 154(b) by 419 days.

(21) Appl. No.: 13/877,523

(22) PCT Filed: Jul. 28, 2011

(86) PCT No.: PCT/JP2011/067329

§ 371 (c)(1),
(2), (4) Date: Apr. 3, 2013

(87) PCT Pub. No.: WO2012/053270

PCT Pub. Date: Apr. 26, 2012

(65) Prior Publication Data

US 2013/0189089 A1 Jul. 25, 2013

(30) Foreign Application Priority Data

Oct. 19, 2010 (JP) ..... 2010-234771

(51) Int. Cl.
*F01D 1/36* (2006.01)
*F01D 25/26* (2006.01)
(Continued)

(52) U.S. Cl.
CPC ..... *F01D 25/00* (2013.01); *F04D 19/042* (2013.01); *F04D 25/068* (2013.01); *F04D 25/0693* (2013.01); *F04D 29/5813* (2013.01)

(58) Field of Classification Search
CPC ..... F04D 19/04; F04D 19/042; F04D 29/582; F04D 29/584; F04D 29/023; F04D 25/0693; F04B 35/045; F16C 32/0489; F16C 2360/45
USPC ..... 417/423.4, 423.8, 423.14, 353, 357, 417/410.1, 44.1; 415/55.1, 55.5, 55.6, 90, 415/121.2, 213.1, 214.1, 220, 175
See application file for complete search history.

(56) References Cited

U.S. PATENT DOCUMENTS 5,971,725 A 10/1999 de Simon et al.
6,316,768 B1 11/2001 Rockwood et al.
(Continued)

FOREIGN PATENT DOCUMENTS

CA 2 695 506 3/2009
DE 2119857 A1 * 4/1971 ..... F04D 19/04
(Continued)

OTHER PUBLICATIONS

First Notice of the Opinion on Examination in Chinese Application No. 2011800487642 (English translation).

*Primary Examiner* — Thai Ba Trieu
(74) *Attorney, Agent, or Firm* — Preti Flaherty Beliveau & Pachios LLP

(57) ABSTRACT

A vacuum pump having substrates which can be wired together easily and cooled easily. A substrate unit structure is formed by covering the opening of the casing of the pump main unit with a plate functioning also as the casing of the control unit. Pins of a terminal fixed while penetrating the plate are soldered directly to an active magnetic bearing (AMB) control substrate and an aerial connection substrate in order to integrate these components. The casing and sealing structures can be of simple construction. A drip-proof structure can be made with the terminal at low cost without using expensive drip-proof connectors. Further, by cooling the plate, electronic components mounted respectively on the AMB control substrate in a vacuum atmosphere and the aerial connection substrate in an air atmosphere can be cooled simultaneously.

8 Claims, 5 Drawing Sheets

(51) Int. Cl.

| | |
|---|---|
| ***F01D 25/28*** | (2006.01) |
| ***F01D 25/24*** | (2006.01) |
| ***F04D 19/04*** | (2006.01) |
| ***F01D 25/00*** | (2006.01) |
| ***F04D 25/06*** | (2006.01) |
| *F04D 29/58* | (2006.01) |

(56) References Cited

U.S. PATENT DOCUMENTS

| | | | | |
|---|---|---|---|---|
| 6,398,524 | B1 | 6/2002 | Taira et al. | |
| 6,644,938 | B2 * | 11/2003 | Omori | 417/423.4 |
| 6,851,848 | B2 * | 2/2005 | Miwata et al. | 374/120 |
| 6,896,764 | B2 * | 5/2005 | Kitazawa | 156/345.29 |
| 7,147,443 | B2 * | 12/2006 | Ogawa et al. | 417/410.1 |
| 7,300,261 | B2 * | 11/2007 | Cafri et al. | 417/423.4 |
| 7,390,164 | B2 * | 6/2008 | Maejima et al. | 415/90 |
| 7,393,228 | B2 * | 7/2008 | Kabasawa et al. | 439/247 |
| 7,679,915 | B2 * | 3/2010 | Isomoto et al. | 361/715 |
| 7,713,087 | B2 * | 5/2010 | Kabasawa et al. | 439/606 |
| 8,221,098 | B2 * | 7/2012 | Yang et al. | 417/423.4 |
| 8,356,970 | B2 * | 1/2013 | Sugawara et al. | 415/121.2 |
| 8,628,309 | B2 * | 1/2014 | Nagano et al. | 417/423.4 |
| 8,961,105 | B2 * | 2/2015 | Kogame | 415/55.1 |
| 2003/0175132 | A1 | 9/2003 | Ishikawa | |
| 2003/0185272 | A1 * | 10/2003 | Miwata et al. | 374/120 |
| 2004/0222126 | A1 * | 11/2004 | Chen et al. | 206/710 |
| 2005/0013703 | A1 * | 1/2005 | Cafri et al. | 417/423.4 |
| 2005/0167049 | A1 * | 8/2005 | Kitazawa | 156/345.26 |
| 2005/0167398 | A1 * | 8/2005 | Kitazawa | 216/59 |
| 2005/0201873 | A1 * | 9/2005 | Ogawa et al. | 417/357 |
| 2006/0118049 | A1 * | 6/2006 | Song et al. | 118/733 |
| 2007/0031270 | A1 * | 2/2007 | Maejima et al. | 417/423.4 |
| 2007/0132327 | A1 | 6/2007 | Brunet | |
| 2007/0237650 | A1 | 10/2007 | Birkenstock et al. | |
| 2008/0007919 | A1 * | 1/2008 | Isomoto et al. | 361/709 |
| 2008/0240905 | A1 * | 10/2008 | Sugawara et al. | 415/121.2 |
| 2012/0143390 | A1 * | 6/2012 | Miwata et al. | 700/300 |
| 2013/0189090 | A1 * | 7/2013 | Okudera et al. | 415/182.1 |
| 2013/0243583 | A1 * | 9/2013 | Kawanishi et al. | 415/191 |
| 2015/0184665 | A1 * | 7/2015 | Yamato et al. | 19/42 |

FOREIGN PATENT DOCUMENTS

| | | | | |
|---|---|---|---|---|
| EP | 597365 | A1 * | 5/1994 | F04D 19/04 |
| EP | 1 732 178 | | 12/2006 | |
| JP | 10-159786 | | 6/1998 | |
| JP | 2004225588 | A * | 8/2004 | F04D 29/58 |
| JP | 2005207275 | A * | 8/2005 | F04D 19/04 |
| JP | 2006250033 | | 9/2006 | |
| JP | 2007-278278 | | 10/2007 | |
| JP | 2012204650 | A * | 10/2012 | F04D 19/04 |
| JP | 2013100760 | A * | 5/2013 | F04D 19/04 |

* cited by examiner

VACUUM PUMP

TECHNICAL FIELD

The present invention relates to a vacuum pump, and particularly relates to a vacuum pump having substrates which can be wired together easily and cooled easily.

BACKGROUND ART

As a result of the recent development of electronics, there is a rapid increase in the demand for semiconductor devices such as memories and integrated circuits.

Such a semiconductor device is manufactured by doping impurities into a highly pure semiconductor substrate to impart electrical properties thereto, and forming a minute circuit on the semiconductor substrate by etching, for example.

Such operations must be performed in a chamber in a high-vacuum state to avoid the influence of dust or the like in the air. A vacuum pump is generally used to evacuate the chamber. In particular, a turbo-molecular pump, which is a kind of vacuum pump, is widely used since it involves little residual gas and is easy to maintain.

When manufacturing a semiconductor, these are many steps for making various process gases act on a semiconductor substrate, and the turbo-molecular pump is used not only to create a vacuum in a chamber, but also to discharge these process gases from the chamber.

This turbo-molecular pump consists of a pump main unit and a control device for controlling the pump main unit. Generally, the pump main unit and the control device are connected through a cable and a connector plug mechanism. As a method for simplifying wiring between substrates by reducing the number of pins of connector plugs for connecting the pump main unit and the control device, Patent Literature 1 suggests that a control substrate for a motor and a magnetic bearing should be arranged on the vacuum side.

CITATION LIST

Patent Literature

[Patent Literature 1] Japanese Unexamined Patent Pub. No. 2007-508492

SUMMARY OF INVENTION

Technical Problem

However, when the control substrate is arranged on the vacuum side, there is a fear that an electrolytic capacitor serving as one of the electronic elements necessary for control bursts and electrolyte leaks therefrom.

When electronic elements generating heat are arranged in the vacuum atmosphere, heat is easily accumulated since the heat is conducted only through radiation in the vacuum atmosphere, which leads to failure of the electronic elements. Further, since the substrate is exposed to corrosive gas etc. depending on the use conditions of the pump, the substrate must be molded to have resistance to corrosion, which also causes accumulation of heat leading to anomalous heating of the electronic elements.

FIG. 4 shows another method for simplifying wiring between substrates, in which the pump main unit 310 and the control device 320 are integrated by connecting a male connector 1 arranged at the bottom of the pump main unit 310 to a female connector 3 arranged at the top of the control device 320. Note that the male connector and the female connector may be switched between the pump main unit and the control device.

In this case, each of the connectors 1 and 3 must have a vacuum sealing structure achieving great airtightness and drip-proof performance, and the pump main unit 310 and the control device 320 must be cooled separately. Further, two plates, which are a bottom plate 5 of the pump main unit 310 and a top plate 7 of the control device 320, are required to separate the pump main unit 310 and the control device 320. Furthermore, as shown in FIG. 5, each of terminal pins 9/11 on the back side of the connector 1/3 has a solder cup 13 for soldering the pin with a cable. Accordingly, cost is increased.

The present invention has been made in view of these conventional problems, and an object thereof is to provide a vacuum pump having substrates which can be wired together easily and cooled easily.

Solution to Problem

Accordingly, the present invention is configured by including: a vacuum pump main unit having a plate on its bottom face; a control unit having the plate as a part of a housing; a plurality of pins fixed to penetrate the plate while being exposed from both surfaces of the plate; a first substrate fixed at an exposed part of the pins on the side of the vacuum pump main unit, the first substrate being arranged in a vacuum atmosphere inside the vacuum pump main unit; and a second substrate fixed at an exposed part of the pins on the side of the control unit, the second substrate being arranged in an air atmosphere inside the control unit.

The plate, the first substrate, and the second substrate are integrated through the pins. Accordingly, configuration of the vacuum pump can be simplified. For example, only one plate may be arranged between the pump main unit and the control unit. Due to the integrated structure, no extra wiring work is required for the substrates.

It is possible to arrange the first substrate in the vacuum atmosphere while arranging, on the second substrate in the air atmosphere, electronic elements difficult to place in the vacuum atmosphere. Since the first substrate is arranged in the vacuum atmosphere, there is no need to lead the lines of electromagnets and sensors to the outside, which makes it possible to reduce the number of lines between the first substrate and the second substrate as much as possible. Further, each of the pins is not required to have a solder cup since the body thereof can be soldered to the substrates. Accordingly, production cost can be reduced.

Further, the present invention is characterized in that an electrolytic capacitor is fixed on the second substrate.

The electrolytic capacitor cannot be placed in the vacuum atmosphere considering the problems of burst etc. Thus, the electrolytic capacitor is fixed to the second substrate. It is desirable that the electrolytic capacitor is fixed near the pins on the substrate. As a result, supply voltage can be stabilized as when the electrolytic capacitor 213 is arranged on the vacuum side.

Furthermore, the present invention is configured by arranging a water-cooling pipe in a base portion of the vacuum pump main unit.

By cooling the plate by the water-cooling pipe, the first substrate in the vacuum atmosphere and the second substrate in the air atmosphere can be cooled simultaneously. Therefore, the cooling structure can be simplified.

Still further, the present invention is configured by arranging sealing members between the plate and the base portion and between the plate and a housing wall of the control unit respectively.

Since the pump main unit and the control unit are integrated while arranging the sealing members, there is no need to arrange a casing and a sealing member for each of the pump main unit and the control unit, differently from the conventional techniques. Accordingly, the casing and sealing structures can be made simple. Further, expensive drip-proof connectors used in the conventional techniques can be replaced with an inexpensive connector.

Advantageous Effects of Invention

As explained above, according to the present invention, configuration of the vacuum pump can be simplified by integrating the plate, the first substrate, and the second substrate through the pins. It is possible to arrange the first substrate in the vacuum atmosphere while arranging, on the second substrate in the air atmosphere, electronic elements difficult to place in the vacuum atmosphere. By arranging the first substrate in the vacuum atmosphere, the number of lines between the first substrate and the second substrate can be reduced as much as possible.

DESCRIPTION OF EMBODIMENTS

Figure 1:
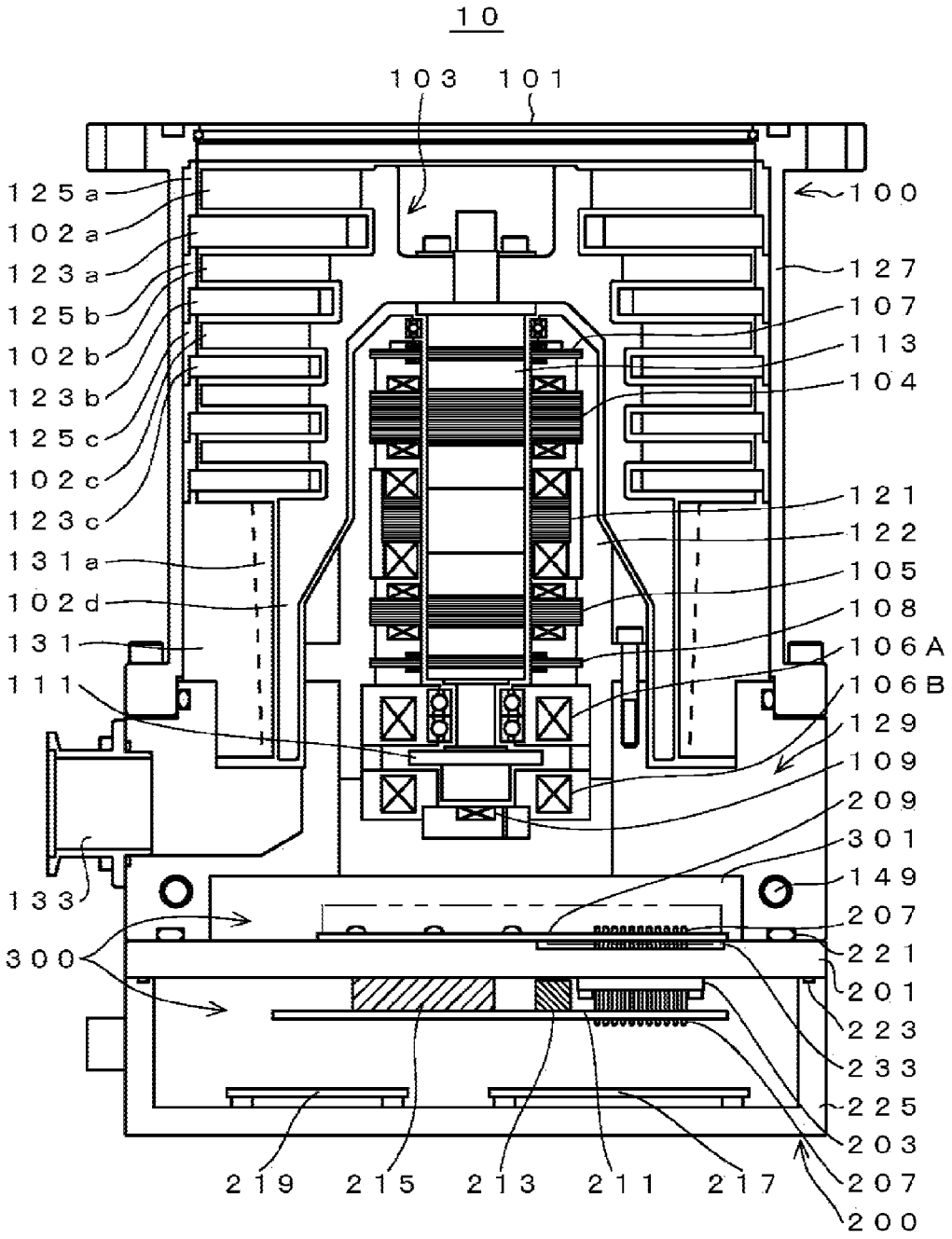
FIG. 1 A block diagram according to an embodiment of the present invention.

Hereinafter, embodiments of the present invention will be explained. FIG. 1 shows a block diagram according to an embodiment of the present invention. In FIG. 1, a turbomolecular pump 10 consists of a pump main unit 100 and a control unit 200 integrated with each other while sandwiching an aluminum plate 201 therebetween.

The plate 201 functions both as the bottom face of the pump main unit 100 and the top face of the control unit 200. However, the plate 201 may be replaced with two plates.

The pump main unit 100 has an inlet port 101 formed at the upper end of an outer cylinder 127. Inside the outer cylinder 127, there is provided a rotor 103 having in its periphery a plurality of rotary blades 102*a*, 102*b*, 102*c*, . . . formed radially in a number of stages and constituting turbine blades for sucking and exhausting gas.

A rotor shaft 113 is mounted at the center of the rotor 103, and is levitated and supported in the air and controlled in position by a so-called 5-axis control magnetic bearing, for example.

Four upper radial electromagnets 104 are arranged in pairs in the X and Y axes which are perpendicular to each other and serve as the radial coordinate axes of the rotor shaft 113. An upper radial sensor 107 formed of four electromagnets is provided in close vicinity to and in correspondence with the upper radial electromagnets 104. The upper radial sensor 107 detects a radial displacement of the rotor 103 and transmits the detection result to a control device 300 (mentioned later.)

Based on the displacement signal from the upper radial sensor 107, the control device 300 controls the excitation of the upper radial electromagnets 104 through a compensation circuit having a PID adjusting function, thereby adjusting the upper radial position of the rotor shaft 113.

The rotor shaft 113 is formed of a material having a high magnetic permeability (e.g., iron), and is attracted by the magnetic force of the upper radial electromagnets 104. Such adjustment is performed independently in the X- and Y-axis directions.

Further, lower radial electromagnets 105 and a lower radial sensor 108 are arranged similarly to the upper radial electromagnets 104 and the upper radial sensor 107 to adjust the lower radial position of the rotor shaft 113 similarly to the upper radial position thereof.

Further, axial electromagnets 106A and 106B are arranged with a metal disc 111 vertically sandwiched therebetween, the metal disc 111 having a circular plate-like shape and arranged at the bottom of the rotor shaft 113. The metal disc 111 is formed of a material having a high magnetic permeability, such as iron. An axial sensor 109 is arranged to detect an axial displacement of the rotor shaft 113, and its axial displacement signal is transmitted to the control device 300.

The axial electromagnets 106A and 106B are excitation-controlled based on this axial displacement signal through a compensation circuit having a PID adjusting function in the control device 300. The axial electromagnet 106A and the axial electromagnet 106B attract the metal disc 111 upward and downward respectively by their magnetic force.

In this way, the control device 300 appropriately adjusts the magnetic force exerted on the metal disc 111 by the axial electromagnets 106A and 106B to magnetically levitate the rotor shaft 113 in the axial direction while supporting it in space in a non-contact state.

A motor 121 has a plurality of magnetic poles circumferentially arranged around the rotor shaft 113. Each magnetic pole is controlled by the control device 300 to rotate and drive the rotor shaft 113 through the electromagnetic force acting between the rotor shaft 113 and the magnetic pole.

A plurality of stationary blades 123*a*, 123*b*, 123*c*, . . . are arranged apart from the rotary blades 102*a*, 102*b*, 102*c*, . . . with small gaps therebetween. The rotary blades 102*a*, 102*b*, 102*c*, . . . are inclined by a predetermined angle from a plane perpendicular to the axis of the rotor shaft 113 in order to transfer the molecules of exhaust gas downward through collision.

Similarly, the stationary blades 123*a*, 123*b*, 123*c*, . . . are inclined by a predetermined angle from a plane perpendicular to the axis of the rotor shaft 113, and arranged alternately with the rotary blades 102*a*, 102*b*, 102*c*, . . . so as to extend toward the inner side of the outer cylinder 127.

One ends of the stationary blades 123*a*, 123*b*, 123*c*, . . . are supported while being fitted into the spaces between a plurality of stationary blade spacers 125*a*, 125*b*, 125*c*, . . . stacked together.

The stationary blade spacers 125*a*, 125*b*, 125*c*, . . . are ring-like members which are formed of, e.g., aluminum, iron, stainless steel, copper, or an alloy containing some of these metals.

The outer cylinder 127 is fixed on the outer periphery of the stationary blade spacers 125 with a small gap therebetween. A base portion 129 is arranged at the bottom of the outer cylinder 127, and a threaded spacer 131 is arranged between the lower end of the stationary blade spacers 125 and the base portion 129. An exhaust port 133 is formed under the threaded spacer 131 in the base portion 129, and communicates with the exterior.

The threaded spacer 131 is a cylindrical member formed of aluminum, copper, stainless steel, iron, or an alloy containing some of these metals, and has a plurality of spiral thread grooves 131*a* in its inner peripheral surface.

The direction of the spiral of the thread grooves 131*a* is determined so that the molecules of the exhaust gas moving in the rotational direction of the rotor 103 are transferred toward the exhaust port 133.

At the lowest end of the rotary blades 102*a*, 102*b*, 102*c*, . . . of the rotor 103, a rotary blade 102*d* extends vertically downward. The outer peripheral surface of this rotary blade 102*d* is cylindrical, and extends toward the inner peripheral surface of the threaded spacer 131 so as to be close to the inner peripheral surface of the threaded spacer 131 with a predetermined gap therebetween.

The base portion 129 is a disc-like member constituting the base portion of the turbo-molecular pump 10, and is generally formed of a metal such as iron, aluminum, and stainless steel.

Further, the base portion 129 physically retains the turbo-molecular pump 10 while functioning as a heat conduction path. Thus, it is desirable that the base portion 129 is formed of a metal having rigidity and high heat conductivity, such as iron, aluminum, and copper.

In this configuration, when the rotor shaft 113 is driven by the motor 121 and rotates with the rotary blades 102, exhaust gas from the chamber is sucked in through the inlet port 101 by the action of the rotary blades 102 and the stationary blades 123.

The exhaust gas sucked in through the inlet port 101 flows between the rotary blades 102 102*a*, 102*b*, 102*c*, . . . and the stationary blades 123*a*, 123*b*, 123*c*, . . . to be transferred to the base portion 129. At this time, the temperature of the rotary blades 102*a*, 102*b*, 102*c*, . . . increases due to frictional heat generated when the exhaust gas comes into contact with or collides with the rotary blades 102*a*, 102*b*, 102*c* . . . , and conductive heat and radiation heat generated from the motor 121, for example. This heat is transmitted to the stationary blades 123*a*, 123*b*, 123*c*, . . . through radiation or conduction by gas molecules of the exhaust gas etc.

The stationary blade spacers 125*a*, 125*b*, 125*c*, . . . are connected together in the outer periphery and transmit, to the outer cylinder 127 and the threaded spacer 131, heat received by the stationary blades 123*a*, 123*b*, 123*c*, . . . from the rotary blades 102*a*, 102*b*, 102*c*, . . . , frictional heat generated when the exhaust gas comes into contact with or collides with the stationary blades 123*a*, 123*b*, 123*c*, . . . , etc.

The exhaust gas transferred to the threaded spacer 131 is transmitted to the exhaust port 133 while being guided by the thread grooves 131*a*.

Further, in order to prevent the gas sucked in through the inlet port 101 from entering an electrical component section formed of the motor 121, the lower radial electromagnets 105, the lower radial sensor 108, the upper radial electromagnets 104, the upper radial sensor 107, etc., the electrical component section is covered with a stator column 122, and the inside of this electrical component section is kept at a predetermined pressure by a purge gas.

Next, configuration of the control device 300 will be explained. Electronic components constituting the control device 300 are stored separately in a bottom space 301 formed between the plate 201 and the base 129 of the pump main unit 100 and in the control unit 200. The inside of the bottom space 301 is set at a vacuum atmosphere, and the inside of the control unit 200 is set at an air atmosphere.

Figure 2:
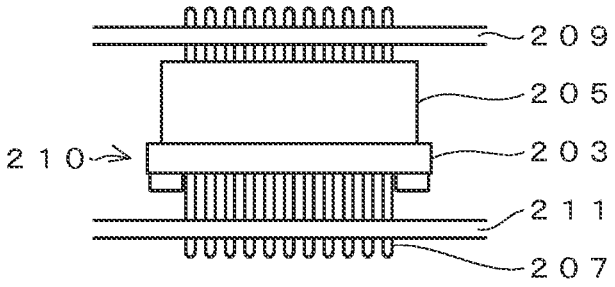
FIG. 2 Terminal structure.

A hole is arranged in a part of the plate 201, and a body 205 of a terminal 210 as shown in FIG. 2 is fixed while penetrating this hole. The body 205 of the terminal 210 has a columnar shape and protrudes from the top face of a roughly-quadrangular bottom plate 203, and many pins 207 are fixed while penetrating the body 205 and the roughly-quadrangular bottom plate 203.

Figure 3:
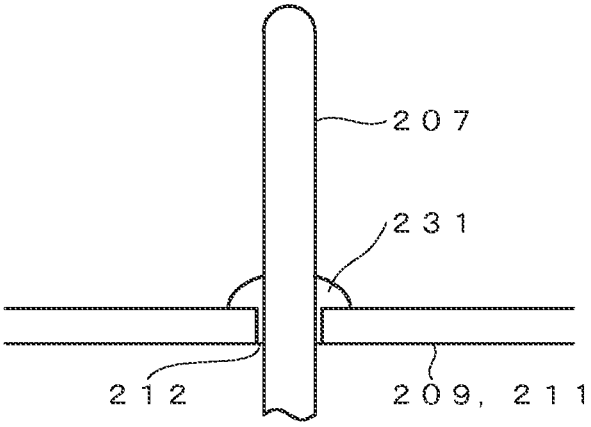
FIG. 3 A diagram showing a pin soldered to a substrate.

The upper parts of the pins 207 are exposed upward from the plate 201 and penetrate pinholes 212 of an AMB control substrate 209. As shown in FIG. 3, the upper parts of the pins 207 are soldered to the AMB control substrate 209 through the pinholes 212 of the AMB control substrate 209. Electronic components for controlling the magnetic bearing are mounted on the AMB control substrate 209.

The pins 207 and the electronic components on the AMB control substrate 209 are electrically connected through the soldered parts.

On the other hand, the lower parts of the pins 207 are exposed downward from the plate 201 and penetrate an aerial connection substrate 211. As shown in FIG. 3, the lower parts of the pins 207 are soldered to the aerial connection substrate 211 through the pinholes 212 of the aerial connection substrate 211. Electronic components for controlling the motor 121 are mounted mainly on the aerial connection substrate 211. The pins 207 and the electronic components on the aerial connection substrate 211 are electrically connected through the soldered parts.

An electrolytic capacitor 213 is arranged near the pins 207 on the aerial connection substrate 211 with its elements facing the plate 201. A heat sink 215 is arranged between the aerial connection substrate 211 and the plate 201. As a result, the AMB control substrate 209, the plate 201, and the aerial connection substrate 211 are integrated into one structure.

Some electronic components which are not used for controlling the magnetic bearing and the motor are mounted on bottom control substrates 217 and 219. However, instead of arranging the substrates depending strictly on the intended use, electronic components excepting the electrolytic capacitor 213 may be arbitrarily mounted on the AMB control substrate 209 in the vacuum atmosphere.

In order to achieve drip-proof performance, an O-ring 221 is embedded between the plate 201 and the base 129 while surrounding the bottom space 301, and an O-ring 223 is embedded between the plate 201 and a wall 225 forming the housing of the control unit 200.

Further, a water-cooling pipe is arranged in the base portion 129 near the plate 201 (see a water-cooling pipe 149 in FIG. 1), which makes it possible to cool the plate 201 through the base portion 129.

Next, operation of the control device 300 will be explained.

A substrate unit structure is formed by covering the opening of the casing of the pump main unit 100 with the plate 201 functioning also as the casing of the control unit 200. The pins 207 of the terminal 210 fixed while penetrating the plate 201 are soldered directly to the AMB control substrate 209 and the aerial connection substrate 211 in order to integrate these components. Therefore, only one plate 201 is arranged between the pump main unit 100 and the control unit 200.

Figure 4:
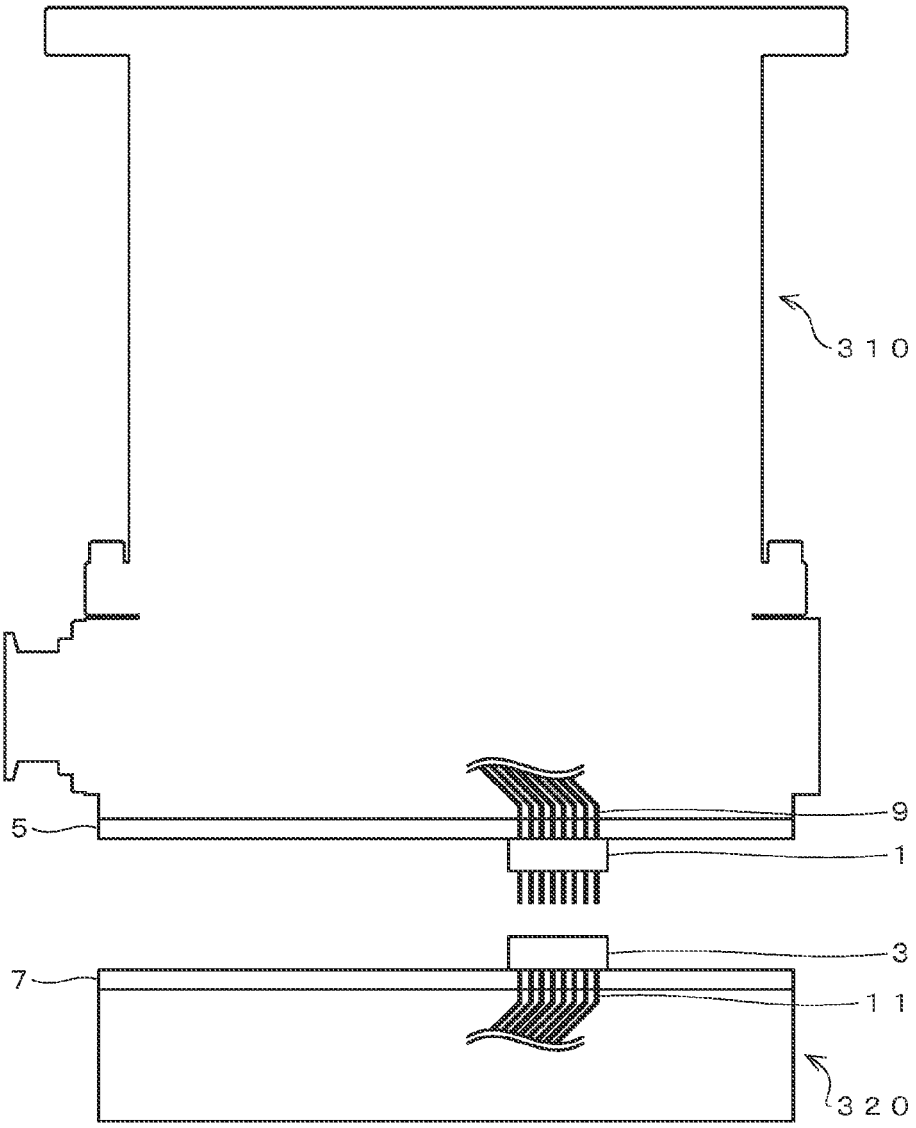
FIG. 4 A diagram showing another method for simplifying wiring between substrates.
Figure 5:
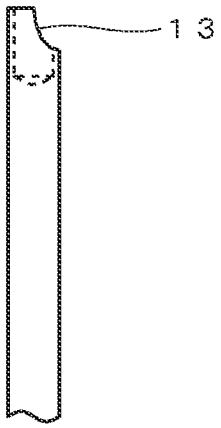
FIG. 5 A diagram showing a pin having a solder cup.

By integrating the pump main unit 100 with the control unit 200, the casing and sealing structures can be made simple, differently from the conventional techniques requiring each of the pump main unit 100 and the control unit 200 to have a casing and a sealing member. Accordingly, the terminal 210 can be made at low cost without using expensive drip-proof connectors 1 and 3 of FIG. 4 showing a conventional technique.

Further, by cooling the plate 201 by the water-cooling pipe 149, electronic components mounted respectively on the AMB control substrate 209 in the vacuum atmosphere and the aerial connection substrate 211 in the air atmosphere can be cooled simultaneously. Therefore, the water-cooling pipe 149 can be used for a plurality of cooling targets, which simplifies the cooling structure.

Each of the pins 207 is not required to have a solder cup since the body thereof is soldered to the substrates 209 and 211 using a solder material 231, as shown in FIG. 3. Accordingly, there is no need to use expensive pins having solder cups, which leads to reduction in production cost.

The AMB control substrate 209 is arranged in the bottom space 301 set at the vacuum atmosphere, and electronic elements difficult to place in the vacuum atmosphere are arranged on the aerial connection substrate 211. Since the AMB control substrate 209, the plate 201, and the aerial connection substrate 211 are integrated into one structure through the pins 207, no extra wiring work is required for the substrates.

Since electronic components for controlling the magnetic bearing are arranged in the bottom space 301 set at the vacuum atmosphere, there is no need to lead the lines of the electromagnets and sensors to the outside, which makes it possible to reduce the number of lines between the AMB control substrate 209 and the aerial connection substrate 211 and the number of pins 207 as much as possible.

It is desirable that the electrolytic capacitor 213 for stabilizing voltage supplied to the magnetic bearing is arranged to be as close as possible to the electronic components mounted on the AMB control substrate 209 to control the magnetic bearing. However, these components cannot be placed in the vacuum atmosphere considering the problems of burst etc., as stated above. Therefore, the electrolytic capacitor 213 is placed close to the pins 207 on the aerial connection substrate 211. As a result, supply voltage can be stabilized as when the electrolytic capacitor 213 is arranged on the vacuum side.

REFERENCE SIGNS LIST

10: Turbo-molecular pump
13: Solder cup
100: Pump main unit
102: Rotary blades
104: Upper radial electromagnets
105: Lower radial electromagnets
106A, B: Axial electromagnets
107: Upper radial sensor
108: Lower radial sensor
109: Axial sensor
111: Metal disc
113: Rotor shaft
121: Motor
122: Stator column
123: Stationary blades
125: Stationary blade spacers
127: Outer cylinder
129: Base portion
131: Spacer
133: Exhaust port
149: Water-cooling pipe
200: Control unit
201: Plate
203: Roughly-quadrangular bottom plate
205: Body
207: Pins
208: supporter
209: AMB control substrate
210: Terminal
211: Aerial connection substrate
212: Pinholes
213: Electrolytic capacitor
215: Heat sink
221, 223: O-rings
300: Control device
301: Bottom space

The invention claimed is:

1. A vacuum pump comprising:
a vacuum pump main unit having a plate on a bottom face of the vacuum pump main unit;
a control unit having the plate as a part of a housing;
a plurality of pins fixed to penetrate the plate while being exposed from both surfaces of the plate;
a first substrate having a conductive part electrically connected to an exposed part of the pins extending from a terminal on a side of the vacuum pump main unit, the first substrate being arranged in a vacuum atmosphere inside the vacuum pump main unit; and
a second substrate having a conductive part electrically connected to an exposed part of the pins extending from the terminal on a side of the control unit, the second substrate being arranged in an air atmosphere inside the control unit.

2. The vacuum pump of claim 1, wherein an electrolytic capacitor is fixed on the second substrate.

3. The vacuum pump of claim 2, wherein a water-cooling pipe is arranged in a base portion of the vacuum pump main unit.

4. The vacuum pump of claim 3, wherein sealing members are arranged between the plate and the base portion and between the plate and a housing wall of the control unit respectively.

5. The vacuum pump of claim 2, wherein sealing members are arranged between the plate and the base portion and between the plate and a housing wall of the control unit respectively.

6. The vacuum pump of claim 1, wherein a water-cooling pipe is arranged in a base portion of the vacuum pump main unit.

7. The vacuum pump of claim 6, wherein sealing members are arranged between the plate and the base portion and between the plate and a housing wall of the control unit respectively.

8. The vacuum pump of claim 1, wherein sealing members are arranged between the plate and the base portion and between the plate and a housing wall of the control unit respectively.

* * * * *